US008746024B2

(12) United States Patent
Baker

(10) Patent No.: US 8,746,024 B2
(45) Date of Patent: Jun. 10, 2014

(54) REBOUND LOCKING MECHANISM

(76) Inventor: Aaron M. Baker, Claremont, CA (US)

( * ) Notice: Subject to any disclaimer, the term of this patent is extended or adjusted under 35 U.S.C. 154(b) by 223 days.

(21) Appl. No.: 13/507,224

(22) Filed: Jun. 14, 2012

(65) Prior Publication Data

US 2013/0333426 A1 Dec. 19, 2013

(51) Int. Cl.
*E05B 47/00* (2006.01)

(52) U.S. Cl.
USPC ..... 70/279.1; 70/275; 70/282; 292/222; 292/224

(58) Field of Classification Search
CPC . E05B 81/25; E05B 47/00; E05B 2047/0015; E05B 2047/0032; E05B 81/24; E05B 81/26; E05B 81/30; E05B 47/0001; E05B 17/0029; E05B 17/0037; E05B 65/52; E05C 3/22; E05C 3/24
USPC ..... 70/275, 279.1, 280, 282, 283.1; 292/220, 222, 224
See application file for complete search history.

(56) References Cited

U.S. PATENT DOCUMENTS

| | | | | | |
|---|---|---|---|---|---|
| 3,566,703 | A * | 3/1971 | Van Noord | 74/50 |
| 3,582,013 | A * | 6/1971 | Beretta | 242/333.3 |
| 3,666,208 | A * | 5/1972 | Beretta | 242/338 |
| 3,768,814 | A * | 10/1973 | Sato | 360/96.51 |
| 4,026,497 | A * | 5/1977 | Yamashita | 242/354.2 |
| 4,177,489 | A * | 12/1979 | Hasegawa | 360/74.2 |
| 4,290,634 | A * | 9/1981 | Gelhard | 292/201 |
| 4,360,803 | A | 11/1982 | Heiland | |
| 4,390,918 | A * | 6/1983 | Matsumoto | 360/137 |
| 4,395,064 | A * | 7/1983 | Bellot et al. | 292/201 |
| 4,442,466 | A * | 4/1984 | Isaki | 360/75 |
| 4,518,180 | A * | 5/1985 | Kleefeldt et al. | 292/201 |
| 4,674,781 | A * | 6/1987 | Reece et al. | 292/336.3 |
| 5,026,093 | A * | 6/1991 | Nishikaji | 280/807 |
| 5,473,336 | A | 12/1995 | Harman et al. | |
| 5,775,142 | A | 7/1998 | Kim | |
| 7,467,815 | B2 * | 12/2008 | Larsen et al. | 292/201 |
| 7,884,293 | B2 | 2/2011 | Ulonek | |
| 8,079,240 | B2 | 12/2011 | Brown et al. | |
| 8,161,781 | B2 | 4/2012 | Gokcebay | |
| 8,456,277 | B2 * | 6/2013 | Gillert et al. | 340/5.61 |
| 2009/0019900 | A1 * | 1/2009 | Min | 70/91 |
| 2010/0139338 | A1 | 6/2010 | Winterstweiger | |

* cited by examiner

*Primary Examiner* — Suzanne Barrett
(74) *Attorney, Agent, or Firm* — Gordon K. Anderson

(57) ABSTRACT

A rebound locking mechanism (10) is taught that consists of a spring loaded shaft (28) having an activating flat (34) thereon, a spring loaded latch (78) interfacing with the shaft activating flat and a rebound plate (40) attached to the shaft. An inertia flywheel (56) having an offset protruding striker (58) is in alignment beneath said rebound plate, with an electric motor (60) rotating the flywheel. In operation when the motor rotates the flywheel in a counter clockwise direction, the striker hits a top surface of the rebound plate and bounces the flywheel clockwise until the striker hits beneath the rebound plate causing the shaft to rotate realigning the flat permitting the latch to rotate under spring urging and thereby repositioning the catch from a locked position into an unlocked position.

19 Claims, 5 Drawing Sheets

REBOUND LOCKING MECHANISM

TECHNICAL FIELD

The present invention relates to locking mechanisms in general. More specifically to a motor momentary driving a flywheel with an offset striker which bounces from the top of a rebound plate to the bottom thereby instigating the mechanical release of a spring loaded latch.

BACKGROUND ART

Previously, many types of electric door locks have been used in endeavoring to provide an effective means to electrically secure a door in most cases using an electromagnetic device to release the latch in some manner.

The prior art listed below did not disclose patents that possess any of the novelty of the instant invention; however the following U.S. patents are considered related:

| Pat. No. | Inventor | Issue Date |
|---|---|---|
| 4,360,803 | Heiland | Nov. 23, 1982 |
| 5,473,236 | Froliv | Dec. 5, 1995 |
| 5,775,142 | Kim | Jul. 7, 1998 |
| 7,884,293 B2 | Ulomek | Feb. 8, 2011 |
| 8,079,240 B2 | Brown et al. | Dec. 20, 2011 |
| 8,161,781 B2 | Gokcebay | Apr. 24, 2012 |

| Patent Application Publication | Inventor | Issue Date |
|---|---|---|
| 2010/0139338 A1 | Winterstweiger | Jun. 10, 2010 |

Heiland in U.S. Pat. No. 4,360,803 teaches a door lock assembly having an electrical alarm system that includes a piezoelectric element located between the lock bolt of the door lock and the lock frame in order to emit a signal to energize the electrical alarm system when pressure is applied between the lock bolt and the frame.

U.S. Pat. No. 5,473,236 issued to Froliv is for an electronic lock that mounts to opposite sides of a door. An electronic reader generates a signal to control the latch installation. A card reader, keypad or contact activation data port generates a signal to actuate a motor to disengage a locking dog allowing rotation of the latch handle. The motor shaft is connected to a drive screw by a coil spring permitting proper operation even if jammed.

Kim in U.S. Pat. No. 5,775,142 discloses a door lock with an electronic keypad and magnetic card reader arranged to send coded signals to a central processing unit that controls a solenoid latch located proximate to the locking bolt. When the solenoid is energized by a signal from the central processing unit (or an auxiliary switch) the locking bolt can be operated from the locked position to the unlocked position; otherwise the solenoid latch prevents the bolt from being operated.

Ulomek in U.S. Pat. No. 7,884,293 B2 teaches a control having housing with a rocker switch mounted on the control housing to drive one lock. The switch has a snap disc which interacts with the switch as the actuator. The control housing has a support bearing and the snap disc is supported with bearing points.

U.S. Pat. No. 8,161,781 B2 issued to Gokcebay is for a locker lock that fits a standard locker door with the electronics contained in a single housing mounted on the front of the locker door. The lock includes a keypad to allow rotation of a handle or knob, and also includes manager's override and power jump terminal.

Winterstweiger in U.S. Patent Application Publication No. 2010/0139338 A1 discloses a lock which may be released on an electrically automated basis for use with locker type storage systems. A lock element is introduced, or blocked, into the locker door lock connecting the door to the element. A lock pawl on a pivot axis releases the spring loaded coupling element when driven by an electromechanical solenoid thus placing the lock in the unlocked position.

For background purposes and as indicative of the art to which the invention is related reference may be made to the remaining cited patent issued to Brown et al. in U.S. Pat. No. 8,079,240 B2.

DISCLOSURE OF THE INVENTION

The entire world has been using locks of one kind or another for centuries to protect valuables and entry into structures which were typically mechanical devices requiring some type of key or entry tool disallowing operation without their presence.

When electricity became in common usage many locks were devised that incorporate an electromechanical method of movement using magnetic attraction to disengage the structure forming the restriction. The embodiment of using a coil around a ferrous stem and electrically energizing the coil causes magnetic attraction or repulsion of the stem which is now in wide use in the form of an electromagnetic solenoid.

While much of the prior art relative to locks has been directed to the use of permanent magnets and electromagnets, however, there have been some problems encountered as the magnets alone are limited in their strength and solenoids are normally spring loaded to allow the ferrous stem to return to its locked condition after operation which may be violated by applying a sever shock such as a sharp blow in the opposite direction which could instantaneous overcome the resistance of the spring and open the lock.

A primary object of the invention is directed to an entirely new and novel method of using electrical energy to indirectly release a latch overcoming the problems of solenoids and magnets. This approach is accomplished using the principles of the flywheel effect without actually attaching anything directly to the electrical device for lock release operation.

An electric motor is used, well known in the art, widely used today and acknowledged for its reliability. The motor is employed exclusively to only start the rotation of a flywheel which includes offset protruding striker. The motor shaft is connected to the flywheel on one end and the motor armature on the other and therefore is free to rotate the flywheel in either direction when deenergized.

When the electric motor is momentarily energized it rotates the flywheel in a counter clockwise direction, where the striker hits a top surface of a rebound plate and bounces the flywheel clockwise until the striker hits beneath the rebound plate causing a connected shaft to rotate realigning a activating flat on the shaft in relation to a latch peripheral recess stop permitting the latch, under torsion spring urging, to rotate repositioning the latch into an unlocked position.

An important object of the invention is that the electricity is used only to start the functional operation and two springs are used to maintain the lock in the closed position neither one is effected by a sever shock in the form of a sharp blow or the like, as the shaft holds the latch in place with an extension spring maintaining contact until the rebound plate acting as a lever arm is contacted by striker with sufficient force to rotate the connected shaft under the tension of the extension spring. When the shaft is rotated an activating flat on the shaft releases the catch and a torsion spring revolves the catch into the unlocked position.

Another object of the invention is that the rebound locking mechanism is completely operable in any orientation as gravity has no affect on any component in the system. If the striker remains in any position even touching the top of the rebound plate the energy in the motor and flywheel is sufficient to operate the invention without any difficulty.

Still another object of the invention is that the mechanism may function with most commonly used keypads, biometric devices, such as fingerprint identification, retinal scanning and voice printing and security tokens or any other well known initial identification procedures even numerical combination security devices.

Yet another object of the invention is the lag time from the signal to start is received until the lock opens is not instantaneous but rapid enough to be completely satisfactory for a user as there are audio indications the lock is functioning when the striker hits the rebound plate on either side and the latch snaps in the open position.

A further object of the invention is in its simplicity as the only electrical requirement is to energize the electric motor for a short period of time which may be accomplished in a myriad of methods well known in the art. A storage battery is all that is required to operate the motor and the application of this power source is in common usage throughout the world particularly at the present with all of the electronic devices to employed today. An auxiliary power receptacle may be added to provide power in the event that the battery ceases to function.

A final object of the invention is that its security is unparalleled as in order to breach the lock it must be physically accessed and to do so the surrounding structure must subsequently be violated.

These and other objects and advantages of the present invention will become apparent from the subsequent detailed description of the preferred embodiment and the appended claims taken in conjunction with the accompanying drawings.

FIG. **8*a*** is a partial isometric view of the retaining ring for the shear shaft of the preferred embodiment completely removed from the invention for clarity.

Figure 9:
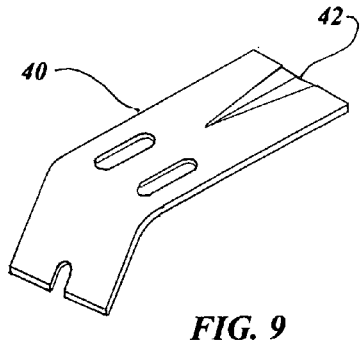
Figure 8:
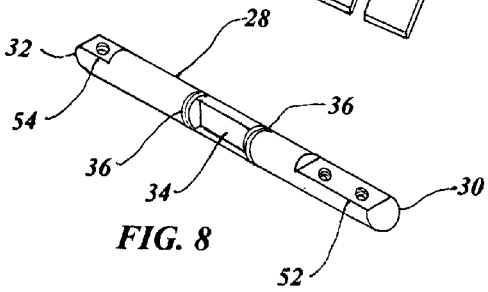
FIG. 8 is a partial isometric view of the shear shaft in the preferred embodiment completely removed from the invention for clarity.

FIG. 9 is a partial isometric view of the rebound plate in the preferred embodiment completely removed from the invention for clarity.

Figure 10:
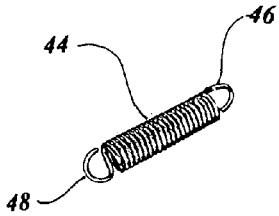
Figure 8A:
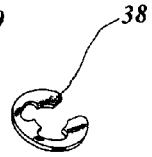

FIG. 10 is a partial isometric view of the extension spring in the preferred embodiment completely removed from the invention for clarity.

Figure 11:
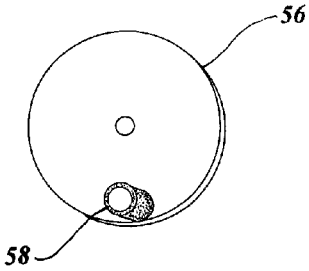

FIG. 11 is a partial isometric view of the flywheel in the preferred embodiment completely removed from the invention for clarity.

Figure 12:
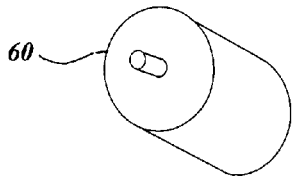

FIG. 12 is a partial isometric view of the electric motor in the preferred embodiment completely removed from the invention for clarity.

Figure 13:
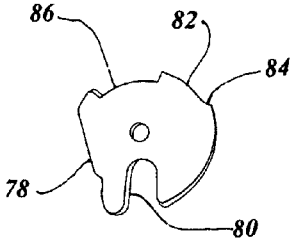

FIG. 13 is a partial isometric view of the latch in the preferred embodiment completely removed from the invention for clarity.

Figure 14:
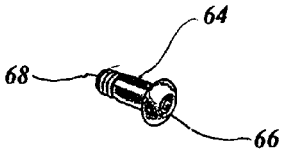

FIG. 14 is a partial isometric view of the latch axle in the preferred embodiment completely removed from the invention for clarity.

Figure 15:
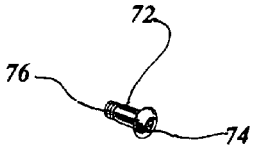

FIG. 15 is a partial isometric view of the rotation limiting pin in the preferred embodiment completely removed from the invention for clarity.

Figure 16:
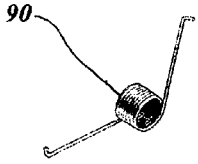

FIG. 16 is a partial isometric view of the torsion spring in the preferred embodiment completely removed from the invention for clarity.

Figure 17:
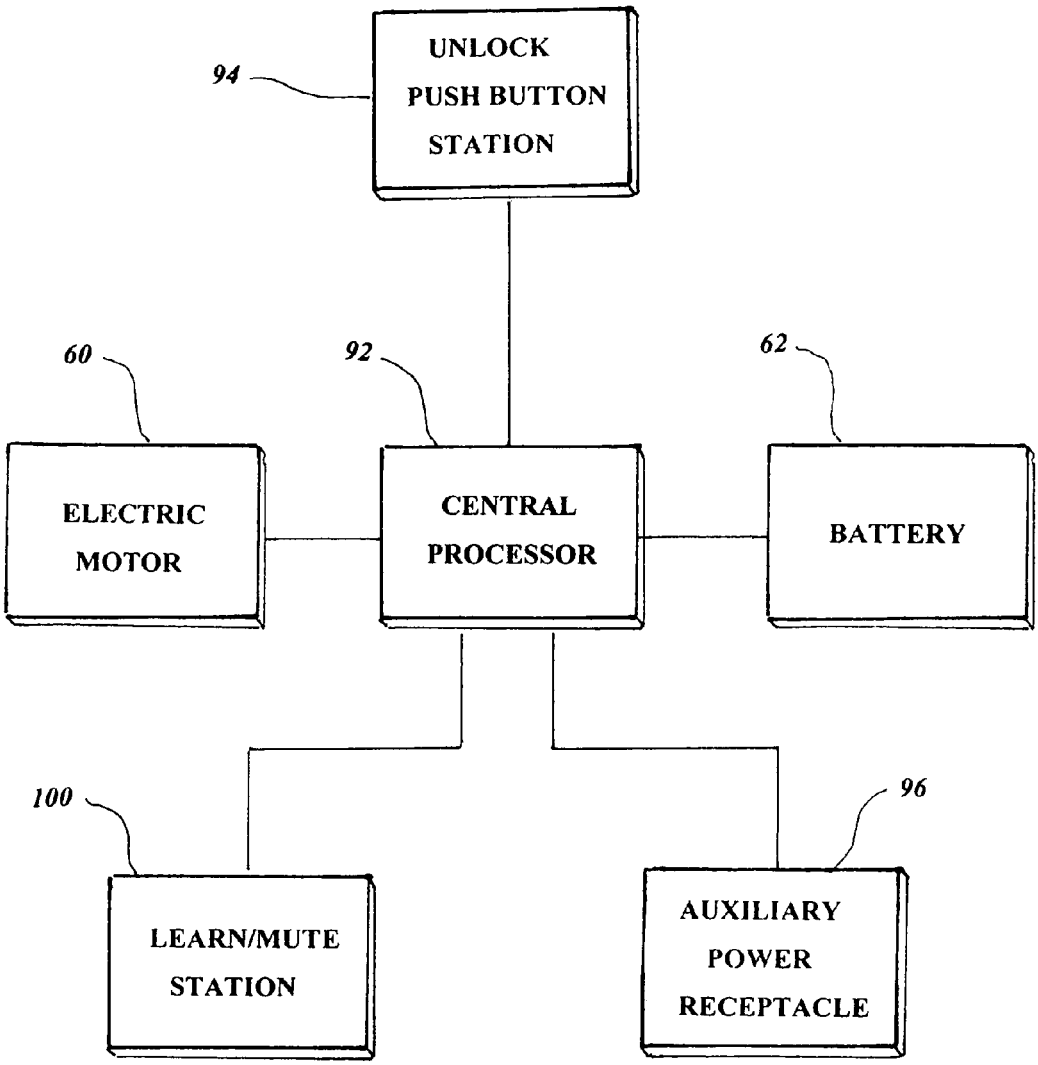

FIG. 17 is a block diagram of the control system for the rebound locking mechanism.

BEST MODE FOR CARRYING OUT THE INVENTION

The best mode for carrying out the invention is presented in terms of a preferred embodiment. This preferred embodiment is shown in FIGS. 1 thorough 17 and is comprised of a rebound locking mechanism 10 consisting of a support housing 20 having a top 22 with juxtaposed sides 24 and a number of integral mounting legs 26 on each juxtaposed side 24 as illustrated in FIGS. 1 and 3-7.

A shear shaft 28 consisting of a front end, 30 a distal end 32, and an activating flat 34 positioned therebetween penetrates completely through the housing 20 and projects outwardly from each support housing side 24. The shear shaft activating flat 34 has a width equivalent to the width extending between the support housing sides 24. A retaining ring groove 36 is positioned equivalent to the outside surface width of each housing support side 24 for maintaining the shaft 28 through the housing 20 with a retaining ring 38.

Figure 1:
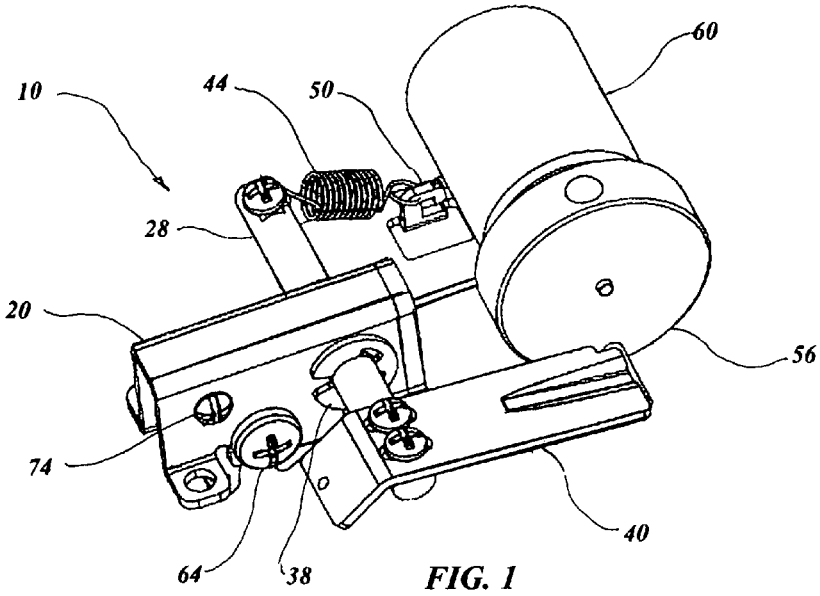
FIG. 1 is a partial isometric view of the rebound locking mechanism in the preferred embodiment.
Figure 2:
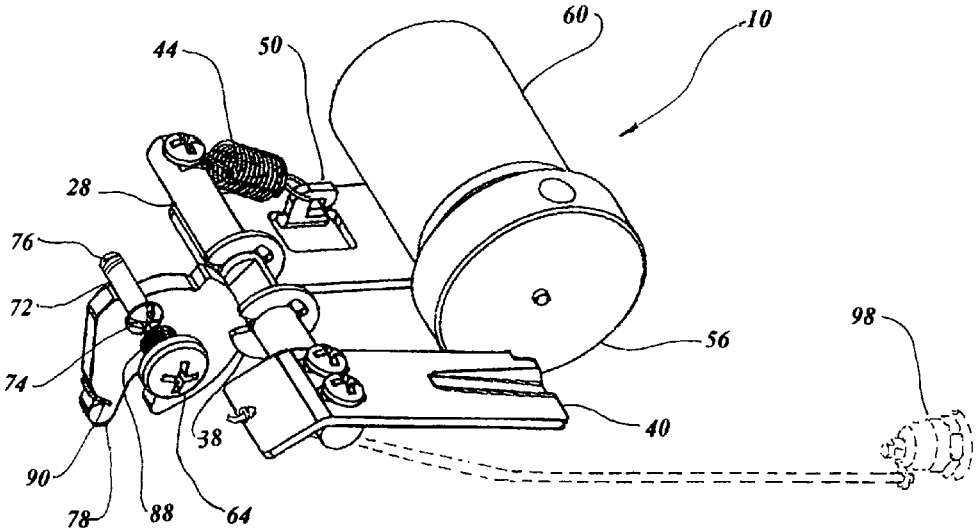
FIG. 2 is a partial isometric view of the rebound locking mechanism with the support housing removed in the preferred embodiment.

A shaft rebound plate 40 having a reinforcing upset portion 42 is attached to the shaft front end 30, as illustrated in FIGS. 1 and 2, with the rebound plate 40 depicted separately in FIG. 9.

An extension spring 44, having a first loop 46 and a second loop 48, is attached on a top surface of the shaft distal end 32 and the second loop 48 is attached to a supported extension spring retainer 50, shown in FIGS. 1-6. The extension spring first loop 46 and second loop 48 each consist of the open end type and the extension spring 44 has a stainless steel or spring steel construction. The shear shaft 28 includes a first flat 52 on the front end 30, for accommodating the rebound plate 40, and the shear shaft 40 has a second flat 54 on its distal end 32 to accommodate the extension spring 44.

Figure 3:
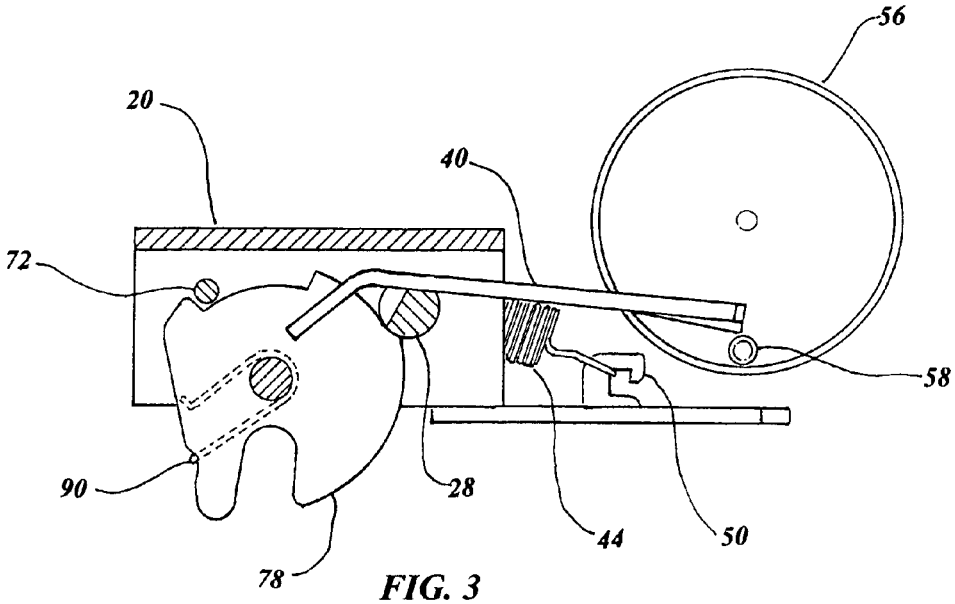
FIG. 3 is a cross sectional view taken along an imaginary centerline of the of the rebound locking mechanism with the flywheel striker in the at rest position and the latch closed.

An inertia flywheel 56 has an offset protruding striker 58 preferably including a resilient covering, as illustrated in FIGS. 1-6 and 11, with the striker 58 at rest in alignment beneath the rebound plate 40, as shown in FIG. 3. An electric motor 60 is attached to the flywheel 56 provides the necessary rotation. The electric motor 60 is energized by a direct current (DC) power source, preferably a 9 volt battery 62 as shown in FIG. 17.

A latch axle 64 penetrates both the housing juxtaposed sides 24, as depicted in FIG. 1, with the latch axle 64 having an axle head 66 on a first end and threads 68 on a second end. One of the support housing sides 24 include a tapped hole 70 for interfacing with said latch axle threads 68 on the second end.

A latch rotation limit pin 72 is disposed completely through the support housing sides 24, as depicted in FIG. 1, with the latch rotation limit pin 72 having a head 74 on a first end and threads 76 on a second end. One of the support housing sides 24 has a similar tapped hole 70 for interfacing with the latch rotation limit pin 72 threads on the second end.

A disc shaped spring loaded latch 78 is rotatably attached on the latch axle 64 between the housing sides 24. The latch 78 has a U-profile notched catch 80, a shaft peripheral recess 82 terminating with a stop 84 corresponding in opposed shape to the radius of the shaft 28 and also a peripheral rotation limit recess 86 thereon, as depicted in FIG. 13. A number of latch spacers 88 are disposed on the latch axle 64 on one side of the latch 78 and a torsion spring 90 is disposed on the latch axle 64 on the opposite side, as illustrated in FIG. 2.

Figure 4:
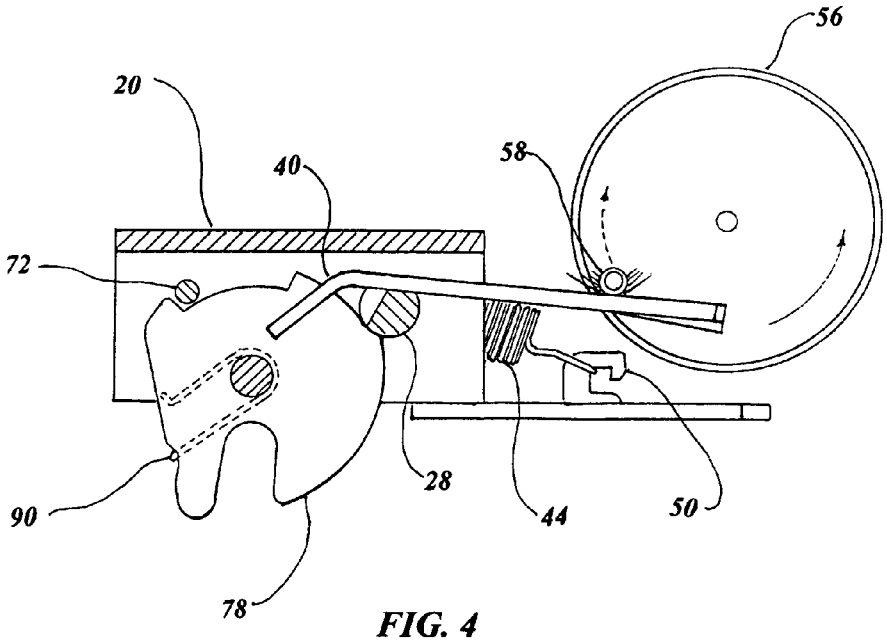
FIG. 4 is a cross sectional view taken along an imaginary centerline of the of the rebound locking mechanism with the electric motor momentarily rotating the flywheel in a counter clockwise direction, allowing the striker to hit the top surface of the rebound plate, bouncing the flywheel upwardly in a clockwise direction.
Figure 5:
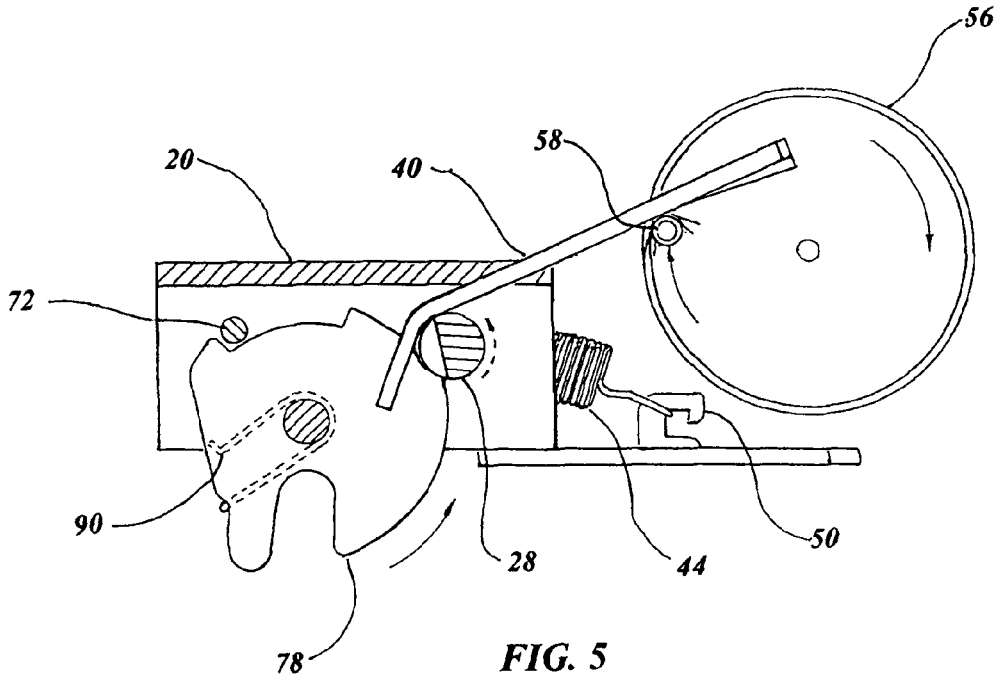
FIG. 5 is a cross sectional view taken along an imaginary centerline of the of the rebound locking mechanism with the striker continuing to circumvolve in a clockwise direction hitting beneath the striker plate causing the shaft to rotate realigning the shaft activating flat in relation to the latch peripheral recess stop subsequently permitting the latch to rotate.
Figure 6:
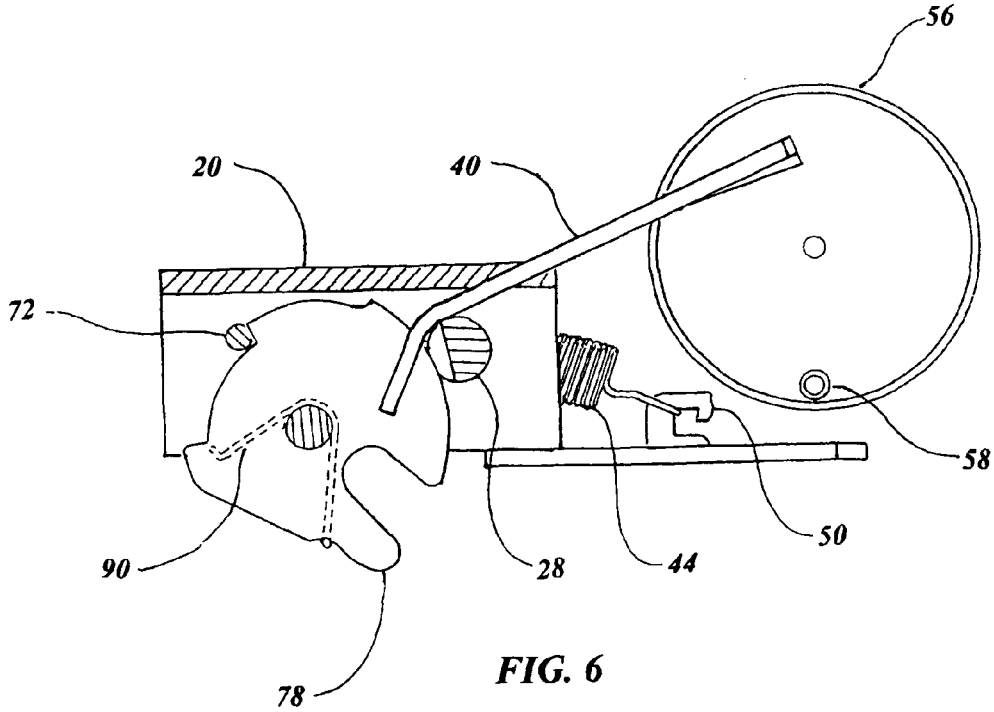
FIG. 6 is a cross sectional view taken along an imaginary centerline of the of the rebound locking mechanism with the latch rotating to the lock open position, within the restriction of the latch rotation limit pin, and the striker returning to an at rest position.
Figure 7:
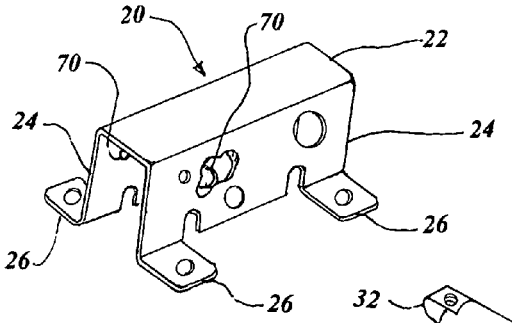
FIG. 7 is a partial isometric view of the support housing in the preferred embodiment completely removed from the invention for clarity.

In operation the electric motor 60 momentarily rotates the flywheel 56 in a counter clockwise direction, as shown in FIG. 4, the striker 58 hits a top surface of the rebound plate 40 and bounces the flywheel 56 clockwise until the striker 58 hits beneath the rebound plate 40. The upward blow of the striker 58 causes the shaft to rotate realigning the shaft activating flat 34 in relation to the latch peripheral recess stop 84, allowing the latch 78 to rotate, as illustrated in FIG. 5. The latch 78 under the urging of the torsion spring 90 is repositioned into an unlocked position depicted in FIG. 6. Manual opening of an article utilizing the locking mechanism resets the latch to a locked position.

There are many methods for controlling the operation of the rebound locking mechanism as well as the initial entry device which include, but not limited to, keypads, biometric fingerprint identification, retinal scanning, voice printing, security tokens etc. FIG. 17 illustrates a scheme, in block diagram form, which incorporates a central processor 92 managing power for momentarily energizing the electric motor 60, and an electronic push button station 94 providing a signal to the central processor 92 allowing entry.

Further an auxiliary power receptacle 96 may be added for supplying electrical power to the central processor 92 in the event that the power of the battery 62 is depleted and a learn/mute station 100 permits the controller 92 to be programmed.

An optional feature may utilize a single key bypass security lock and a cable 98 mechanically attached to the shaft rebound plate 40, as illustrated with dash lines in FIG. 2.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

ADDENDUM REBOUND LOCKING MECHANISM
Element Designation
(For convenience of the Examiner, not part of the specification)

| | |
|---|---|
| 10 | rebound locking mechanism |
| 20 | support housing |
| 22 | support housing top |
| 24 | support housing sides |
| 26 | integral mounting legs (on 24) |
| 28 | shear shaft |
| 30 | front end (of 28) |
| 32 | distal end (of 28) |
| 34 | activating flat (on 28) |
| 36 | retaining ring groove (in 28) |
| 38 | retaining ring |
| 40 | rebound plate |
| 42 | reinforced upset portion (of 40) |
| 44 | extension spring |
| 46 | first loop (of 44) |
| 48 | second loop (of 44) |
| 50 | extension spring retainer |
| 52 | first flat (28) |
| 54 | second flat (28) |
| 56 | flywheel |
| 58 | striker (on 56) |
| 60 | electric motor |
| 62 | 9 volt battery |
| 64 | latch axle |
| 66 | axle head |
| 68 | axle threads |
| 70 | tapped hole (in 24) |
| 72 | latch rotation limiting pin |
| 74 | head (of 72) |
| 76 | threads (on 72) |
| 78 | latch |
| 80 | catch (of 78) |
| 82 | peripheral recess (in 78) |
| 84 | stop (in 78) |
| 86 | rotation limit recess (in 78) |
| 88 | latch spacers (on 28) |
| 90 | torsion spring (on 28) |
| 92 | central processor |
| 94 | push button station |
| 96 | auxiliary power receptacle |
| 98 | key lock and cable |
| 100 | learn/mute station |

The invention claimed is:

1. A rebound locking mechanism which comprises:

a spring loaded shaft having an activating flat thereon, a spring loaded latch interfacing with the shaft activating flat and a rebound plate attached to the shaft, and an inertia flywheel having an offset protruding striker in alignment beneath said rebound plate, with an electric motor rotating the flywheel, such that when the motor rotates the flywheel in a counter clockwise direction, the striker hits a top surface of the rebound plate and bounces the flywheel clockwise until the striker hits beneath the rebound plate causing the shaft to rotate realigning the flat permitting the latch to rotate, under spring urging, therefore repositioning the catch from a locked position into an unlocked position.

2. A rebound locking mechanism which comprises;

a shaft having an activating flat contained thereon, a shaft rebound plate attached to said shaft on a front end of the shaft, an inertia flywheel having an offset protruding striker, with the striker in alignment beneath said rebound plate, an electric motor attached to said flywheel for rotation thereof, and a rotation limited spring loaded latch having a U-profile notched catch therein, engaging said shaft adjacent to said activating flat, such that when the electric motor momentarily rotates the flywheel in a counter clockwise direction, the striker hits a top surface of the rebound plate and bounces the flywheel clockwise until the striker hits beneath the rebound plate causing the shaft to rotate realigning the shaft activating flat therefore permitting the latch to rotate under spring urging, repositioning the catch into an unlocked position, manual opening of an article utilizing the locking mechanism resets the latch to a locked position.

3. A rebound locking mechanism which comprises;

a support housing having a top and juxtaposed sides, a shear shaft having a front end, a distal end, and an activating flat positioned therebetween, wherein the shear shaft penetrates completely through said housing and projects outwardly from each support housing side, a shaft rebound plate attached to said shaft front end, an extension spring having a first loop and a second loop, the first loop attached on a top surface of said shaft distal end and the second loop attached to a supported extension spring retainer, an inertia flywheel having an offset protruding striker, with the striker at rest in alignment beneath said rebound plate, and an electric motor attached to the flywheel for rotation thereof, a latch axle penetrating said housing juxtaposed sides, and a disc shaped spring loaded latch, having a U-profile notched catch, a shaft peripheral recess terminating with a stop corresponding in opposed shape to a radius of said shaft and the latch having a peripheral rotational limit recess thereon, wherein the axle positions the latch in between the housing juxtaposed sides, such that when the electric motor momentarily rotates the flywheel in a counter clockwise direction, the striker hits a top surface of the rebound plate and bounces the flywheel clockwise until the striker hits beneath the rebound plate causing the shaft to rotate realigning the shaft activating flat in relation to the latch peripheral recess stop therefore permitting the latch to rotate, under torsion spring urging, therefore repositioning the catch into an unlocked position, manual opening of an article utilizing the locking mechanism resets the latch to a locked position.

4. The rebound locking mechanism as recited in claim 3 wherein said support housing further comprises a plurality of integral mounting legs on each juxtaposed side.

5. The rebound locking mechanism as recited in claim 3 wherein said shear shaft activating flat having a width equivalent to a width extending between said support housing sides, 6. The rebound locking mechanism as recited in claim 3 wherein shear shaft further having a retaining ring groove positioned equivalent to a width of the outside surface of each housing support side.

7. The rebound locking mechanism as recited in claim 6 further comprising a retaining ring disposed within each retaining ring groove for positioning the shear shaft activating flat relative to the latch.

8. The rebound locking mechanism as recited in claim 3 wherein said shear shaft further comprises a first flat on said front end for accommodating said rebound plate and said shear shaft having a second flat on said distal end for accommodating said extension spring.

9. The rebound locking mechanism as recited in claim 3 wherein said shaft rebound plate further comprises a reinforcing upset portion to strengthen said shaft rebound plate where said flywheel offset protruding striker impinges.

10. The rebound locking mechanism as recited in claim 3 wherein said extension spring first loop and said second loop each further comprise an open end loop with said extension spring having a stainless steel or spring steel construction.

11. The rebound locking mechanism as recited in claim 3 wherein said inertia flywheel electric motor is energized by a direct current (DC) power source.

12. The rebound locking mechanism as recited in claim 11 wherein said electric motor power source is a 9 volt battery.

13. The rebound locking mechanism as recited in claim 3 wherein said latch axle having a head on a first end and threads on a second end, wherein at least one support housing side having a tapped hole for interfacing with said latch axle threaded second end.

14. The rebound locking mechanism as recited in claim 3 further comprising a latch rotation limit pin disposed completely through said support housing sides slideably interfacing with said peripheral rotational limit recess, the latch rotation limit pin having a head on a first end and threads on a second end, wherein at least one support housing side having a tapped hole for interfacing with said latch rotation limit pin threaded second end.

15. The rebound locking mechanism as recited in claim 14 further comprises a plurality of latch spacers disposed on said latch axle on one side of said latch and a torsion spring is disposed on said latch axle on an opposite side of said latch.

16. The rebound locking mechanism as recited in claim 3 further comprising a central processor providing power to momentarily energize said electric motor.

17. The rebound locking mechanism as recited in claim 16 further comprising an electronic push button station to provide a signal to said central processor.

18. The rebound locking mechanism as recited in claim 16 further comprising an auxiliary power receptacle for supplying electrical power to said central processor in the event that battery power is depleted.

19. The rebound locking mechanism as recited in claim 3 further comprising a single key bypass security lock and a cable mechanically attached to said shaft rebound plate.

* * * * *